US010427844B2

(12) United States Patent
Kovitz et al.

(10) Patent No.: US 10,427,844 B2
(45) Date of Patent: Oct. 1, 2019

(54) CONTAINER LID

(71) Applicant: SHAKE N' SHARE LLC, Mount Pleasant, MI (US)

(72) Inventors: Justin Kovitz, Mount Pleasant, MI (US); Raymond Kovitz, Mount Pleasant, MI (US)

(73) Assignee: SHAKE N' SHARE LLC, Mount Pleasant, MI (US)

( * ) Notice: Subject to any disclaimer, the term of this patent is extended or adjusted under 35 U.S.C. 154(b) by 0 days.

(21) Appl. No.: 14/334,912

(22) Filed: Jul. 18, 2014

(65) Prior Publication Data

US 2015/0021335 A1 Jan. 22, 2015

Related U.S. Application Data

(60) Provisional application No. 61/847,690, filed on Jul. 18, 2013.

(51) Int. Cl.
*B65D 51/28* (2006.01)
*B65D 43/02* (2006.01)

(52) U.S. Cl.
CPC ..... *B65D 51/28* (2013.01); *B65D 43/0212* (2013.01); *B65D 2543/00092* (2013.01); *B65D 2543/00296* (2013.01); *B65D 2543/00351* (2013.01); *B65D 2543/00527* (2013.01); *B65D 2543/00537* (2013.01); *B65D 2543/00731* (2013.01); *B65D 2543/00805* (2013.01)

(58) Field of Classification Search
CPC ..... B65D 51/28; B65D 43/0212
USPC ..... 220/521
See application file for complete search history.

(56) References Cited

U.S. PATENT DOCUMENTS

| | | | | |
|---|---|---|---|---|
| D48,241 | S | 12/1915 | Churchill | |
| D54,898 | S | 4/1920 | Churchill | |
| D54,981 | S | 4/1920 | Colomb | |
| 2,673,805 | A | 3/1954 | Colman | |
| 2,677,947 | A | 5/1954 | Van Guilder | |
| 2,922,563 | A * | 1/1960 | Aldington ..... | B65D 43/0212 206/508 |

(Continued)

OTHER PUBLICATIONS

Nordic Wear, Microwave Spatter Cover, Jan. 14, 2013;https://www.nordicware.com/store/product_detail/10-spatter-cover#.Vp1TC_krKUk.

(Continued)

*Primary Examiner* — Jeffrey R Allen
(74) *Attorney, Agent, or Firm* — Avery N. Goldstein; Blue Filament Law PLLC

(57) ABSTRACT

An inventive lid with a collar that adjusts to variations in bucket diameters and lip thicknesses is provided. The inventive lid collar has a series of detents for engaging the bucket lip when the lip is within design limits, however when the lip's thickness is greater than designed tolerance, or the buckets diameter is larger than specified, the lid collar has an expandable under hang the grabs the bucket lip. The under hang provides an inward spring force that grabs the bucket lip regardless of whether the lip's thickness is over or under specified tolerances. The inventive lid have an upper recess indent for holding printed material, such as a coupon or illustration, or a smaller container for holding a premium or for holding spices in a single or multi chamber dispenser within the recess or secured inside the dome.

18 Claims, 3 Drawing Sheets

(56) References Cited

U.S. PATENT DOCUMENTS

| | | | | | |
|---|---|---|---|---|---|
| 3,070,275 | A * | 12/1962 | Bostrom | B65D 51/28 | 220/500 |
| D219,052 | S | 10/1970 | Gulotta | | |
| D239,999 | S | 5/1976 | Christain et al. | | |
| D280,062 | S | 8/1985 | Cesaroni | | |
| 4,863,058 | A * | 9/1989 | Antoni | B65D 43/0212 | 215/321 |
| 4,928,842 | A | 5/1990 | Swenson | | |
| 5,082,140 | A | 1/1992 | Swenson | | |
| 5,214,257 | A | 5/1993 | Riskey | | |
| D383,646 | S | 9/1997 | Jeppesen et al. | | |
| 6,116,772 | A | 9/2000 | DiGiacomo et al. | | |
| D482,575 | S | 11/2003 | Mountain | | |
| D512,598 | S | 12/2005 | Shore | | |
| D521,796 | S | 5/2006 | Bertulis | | |
| D577,288 | S | 9/2008 | Wilson et al. | | |
| D615,797 | S | 5/2010 | Berge et al. | | |
| D626,790 | S | 11/2010 | Gibson et al. | | |
| 7,823,743 | B2 * | 11/2010 | McKahan | B65D 71/20 | 220/212 |
| 8,448,801 | B2 * | 5/2013 | Rusnak | B65D 43/0231 | 220/23.83 |
| D725,957 | S | 4/2015 | Simpson | | |
| 2011/0274804 | A1 | 11/2011 | Barrows et al. | | |
| 2013/0068772 | A1 * | 3/2013 | Durdon | B65D 43/0212 | 220/521 |
| 2014/0217096 | A1 | 8/2014 | Simpson | | |

OTHER PUBLICATIONS

Garet Ellison, "Plastic popcorn lid made in Grand Rapids shaking up theater concessions across the country", article Aug. 7, 2013, MLive, Michigan; http://www.mlive.com/business/west-michigan/index.ssf/2013/08/shake_n_share.html.

* cited by examiner

CONTAINER LID

CROSS-REFERENCE TO RELATED APPLICATIONS

This application claims priority benefit of U.S. Provisional Application Ser. No. 61/847,690 filed on Jul. 18, 2013; the content of which is hereby incorporated by reference.

FIELD OF THE INVENTION

The present invention in general relates to product packaging, and in particular to a container lid for covering buckets primarily used for serving food.

BACKGROUND OF THE INVENTION

Food is often enjoyed at entertainment venues such as sporting events and movie theaters in disposable containers that are equally convenient for the food purveyor and consumer. Often at these venues snacks are served in containers with a corresponding lid. Convenience foods such as popcorn and chicken are often served in buckets with a lid. However, to control costs tolerances between the lid and bucket are generally not kept tightly. Buckets are often made of paper or corrugated materials, while the lids are usually made of plastic each with their own manufacturing challenges and accepted tolerances. Furthermore, lids may be manufactured by one vendor, while the buckets are manufactured by a different producer. As a result, the variations between the diameters of the lid and bucket, or in the thickness of the bucket lip may lead to loose or non-fitting lids. The loose or non-fitting covers lead to waste and dissatisfied customers.

Thus, there exists a need for a lid that adjusts to variations in bucket diameters and lip thicknesses.

SUMMARY OF THE INVENTION

A lid that adjusts to variations in bucket diameters and lip thicknesses is provided. Embodiments of the lid have a collar designed to adjust to variations in bucket diameter or in bucket overhang lip thicknesses. The lid has a series of detents for engaging the bucket lip when the lip is within design limits, however when the lip's thickness is greater than designed tolerance, or the buckets diameter is larger than specified, the lid collar has an expandable under hang the grabs the bucket lip. The under hang provides an inward spring force that grabs the bucket lip regardless of whether the lip's thickness is over or under specified tolerances.

Embodiments of the lid may have an upper aperture recess for holding printed material, such as a coupon or illustration, or a smaller container for holding a premium, such as toy, or for holding spices in a single or multi chamber dispenser. Embodiments of the lid may be clear or opaque and are made of plastic.

BRIEF DESCRIPTION OF THE DRAWINGS

The present invention is further detailed with respect to the following drawings that depict particular embodiments with greater specificity. These drawings should not be construed as limiting the scope of the appended claims.

DESCRIPTION OF THE INVENTION

An inventive lid that adjusts to variations in bucket diameters and lip thicknesses is provided and has utility in the consumption of foods and in particular popcorn, French fries, and other such products. Embodiments of the inventive lid have a collar designed to adjust to variations in bucket diameter or in bucket overhang lip thicknesses. The inventive lid has a series of detents for engaging the bucket lip when the lip is within design limits, however when the thickness of the lip is greater than designed tolerance, or the buckets diameter is larger than specified, the lid collar has an expandable under hang the grabs the bucket lip. The under hang provides an inward spring force that grabs the bucket lip regardless of whether the lip's thickness is over or under specified tolerances.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Embodiments of the inventive lid may have an upper aperture recess for holding printed material, such as a coupon or illustration, or a smaller container for holding a premium, such as toy, or for holding spices in a single- or multi-chamber dispenser. Embodiments of the inventive lid may be clear or opaque and are made of plastic.

Figure 1:
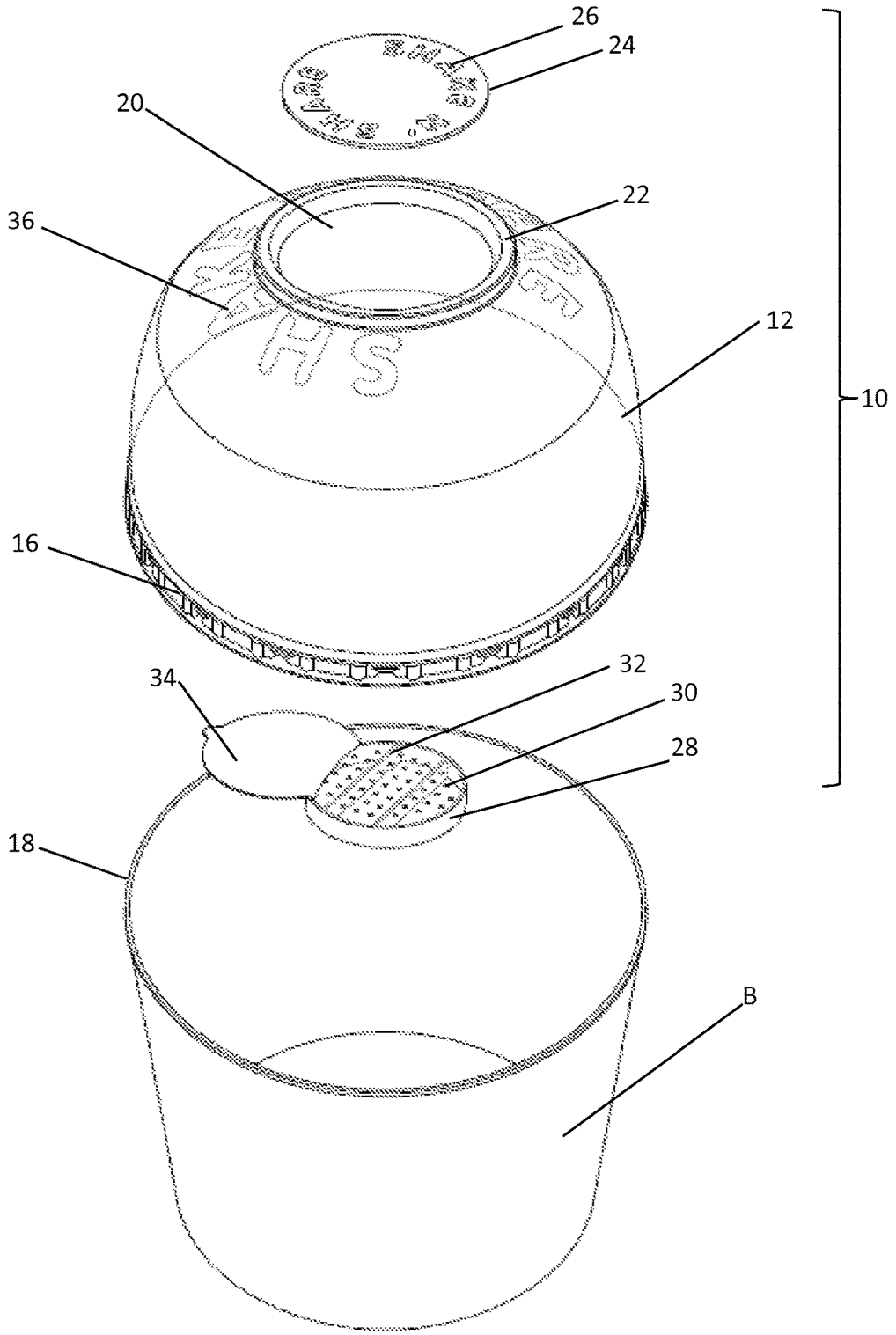
FIG. 1 is an exploded perspective view of an embodiment of an inventive lid with a bucket shown, the bucket not being part of the container lid.

Referring now to figures, FIG. 1 is an exploded perspective view of an embodiment of an inventive lid 10 with a bucket B shown. It is appreciated that while an inventive lid 10 joins to the bucket B to form an integral unit, the bucket B is otherwise conventional to the art. The lid 10 has a sidewall 12 extending from a lower collar 16 and narrows to form a dome. In some embodiments, the lid apex terminates in an upper recess 20. The side wall 12 may have a curved or bowl shape as it extends upward. The upper recess 20 has a raised border indent circumference 22 that secures a printed disc 24 and/or a small container 28. Characters or indicia 36 may be printed or molded on the sidewall 12. The printed disc 24 may have illustrations, advertisements, printed indicia, advertising barcodes, or coupons as evidenced by characters 26. Embodiments of the small container 28 may have a peel-off or reseal-able cover 34 for holding a premium, condiments, or spices (as shown). When holding spices, the container 28 may have partitions 30 that separate the spices and holes 32 for pouring the spices on the content in the bucket B. The inventive lid 10 secures the adjusting collar 16 to the bucket B via lip 18.

Figure 2:
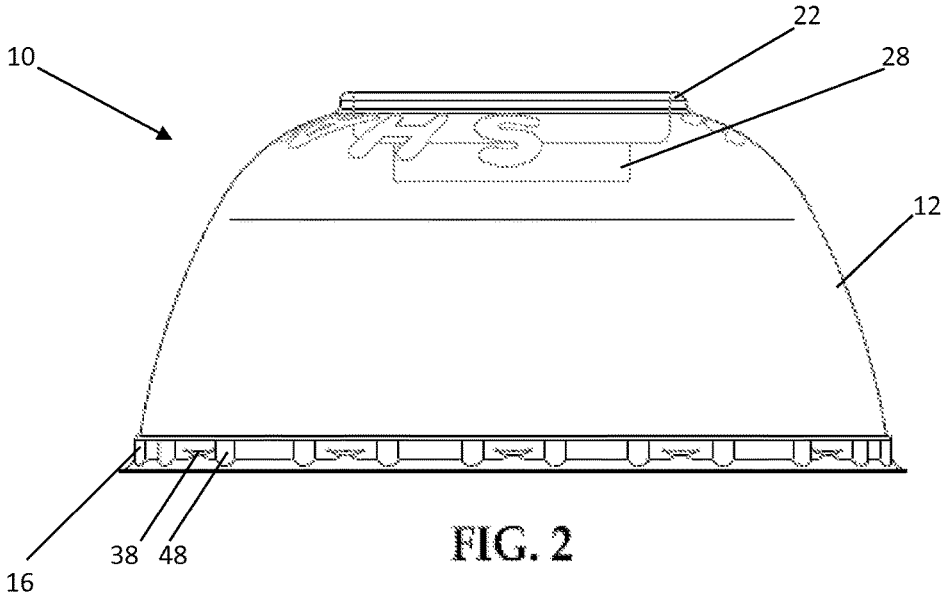
FIG. 2 is a side view of the container lid depicted in FIG. 1.
Figure 3:
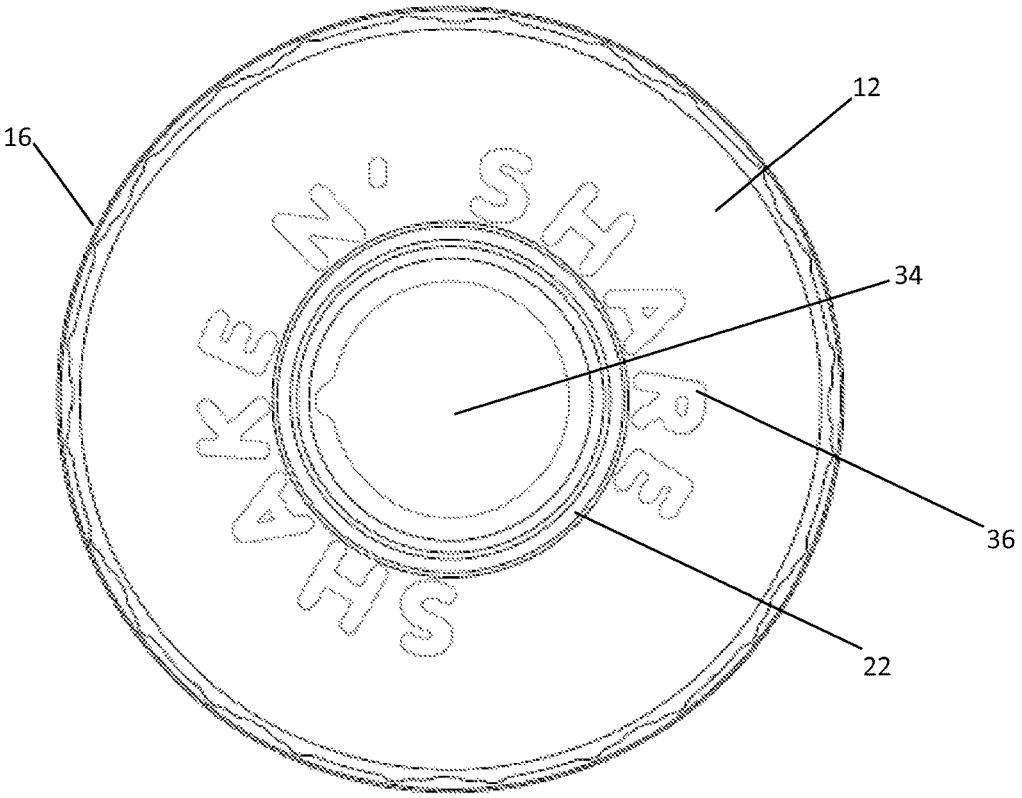
FIG. 3 is a top view of the container lid depicted in FIG. 1.
Figure 4A:
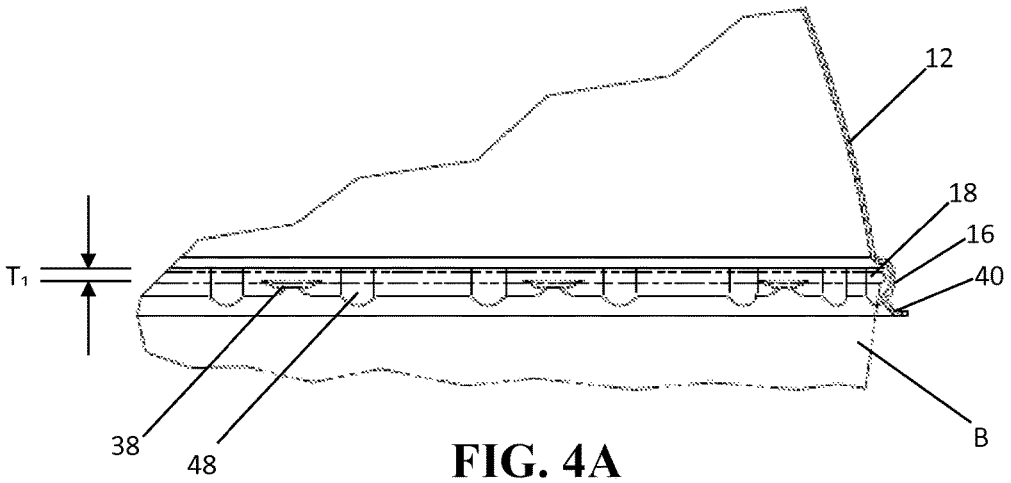
FIGS. 4A-4C are a series of partial cross-sectional views of the lid and bucket of FIG. 1 when engaged showing the interface and accommodation of the lid for variations in the thickness of the bucket lip according to embodiments of the invention.

As more clearly shown in FIGS. 2-4 the adjust collar 16 has a series of detents 38 that latch on to the lip 18 of the bucket B. The detents 38 are able to latch on to the lip 18 when the lip 18 is within a specified thickness $T_1$ as shown in FIG. 4A. Each detent 38 projects inward toward the central area of the collar 16. In some embodiments, detents 38 are bounded by one or two ribs 48, the ribs 48 server to strengthen the lid 10. A rib 48 that is substantially orthogonal to the contiguous detent 38 is provided in some inventive embodiments. Between 3 and 36 detents 38 are provided in some embodiments of an inventive lid around the periphery of the collar 16, although it is appreciated that a greater number of detents 38 are readily provided based on the size of the container, thickness of the plastic from which the lid 10 is formed, and other variables known to the art.

Figure 4B:
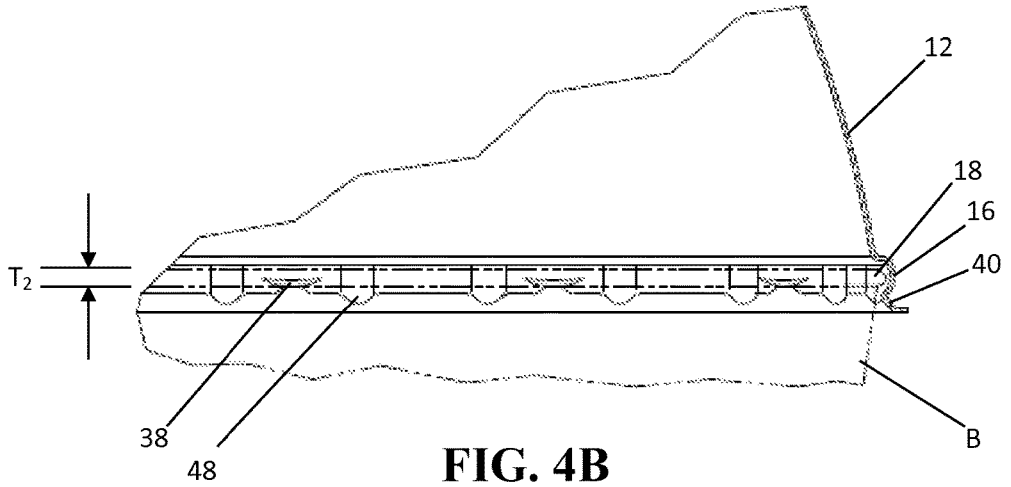
Figure 4C:
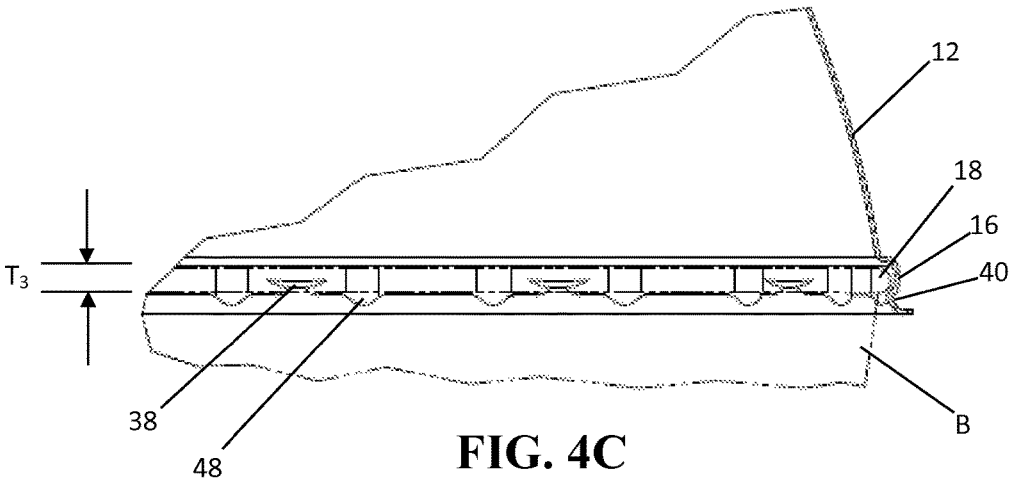

When the thickness of the lip 18 is greater than specified as shown in FIGS. 4B and 4C for thicknesses $T_2$ and $T_3$, respectively, the detents 38 are unable to latch on to the lip 18. In these instances, the collar 16 flexes outward, and under hang 40 grabs the lip 18. The under hang 40 is also able to compensate for variations in the diameter of the bucket B.

The foregoing description is illustrative of particular embodiments of the invention, but is not meant to be a limitation upon the practice thereof. The following claims, including all equivalents thereof, are intended to define the scope of the invention.

The invention claimed is:

1. A lid for a bucket, said lid comprising:

a side wall extending upward from a collar along a circular lower edge and forming a dome;

said collar selectively securing said lid to said bucket, said bucket being formed of paper or corrugated material and having a lip with a thickness along a circumference of a top portion of said bucket, where said collar has a plurality of horizontal detents shaped as trapezoids that project inward toward a central axis of said collar and to a greater extent than the circular lower edge to latch onto a bottom portion of said lip when said lip is within a specified thickness, each of said plurality of horizontal detents vertically offset above the circular lower edge of said collar and each of said plurality of horizontal detents having a lower width proximal to the circular lower edge that is less than an upper width proximal to said side wall, each of said plurality of horizontal detents separated by at least one of a plurality of outwardly extending ribs and a region lacking a horizontal detent, each of said plurality of outwardly extending ribs being orthogonal to said detents; and a flexible and expandable under hang disposed below said plurality of detents, said flexible and expandable under hang having a diameter, said under hang having an circumferential indentation with an inward spring force that grabs said lip of said bucket when said lip is greater than the specified thickness and when said lip is less than the diameter such that said plurality of horizontal detents latch onto a bottom portion of said lip and able to compensate for a variation in the circumference of said bucket;

wherein each of said plurality of outwardly extending ribs extends from between said plurality of horizontal detents into said flexible and expandable under hang.

2. The lid of claim 1 wherein said dome terminates in a recess at an upper portion of said lid.

3. The lid of claim 2 further comprising a small container secured inside said dome and under the recess.

4. The lid of claim 3 wherein said small container holds a premium.

5. The lid of claim 3 wherein said small container holds seasonings or condiments separated into one or more chambers for dispersal in said bucket.

6. The lid of claim 3 wherein said small container further comprises a peel-off or a reseal-able cover.

7. The lid of claim 2 wherein said recess further comprises an upper recess indent for holding a disc.

8. The lid of claim 7 wherein said disc has at least one of illustrations, advertisements, printed indicia, advertising barcodes, or coupons.

9. The lid of claim 7 wherein said upper recess indent defines a volume.

10. The lid of claim 9 further comprising a condiment, a seasoning, or a premium in-the volume.

11. The lid of claim 1 wherein said side wall is curved.

12. The lid of claim 1 wherein said side wall is clear or opaque.

13. The lid of claim 1 further wherein each of said plurality of outwardly extending ribs is contiguous to at least one of said plurality of detents.

14. A lid for a bucket, said lid comprising:

a side wall extending upward from a collar along a circular lower edge and forming a dome;

said collar selectively securing said lid to said bucket with a plurality of trapezoid-shaped detents projecting inward toward a central area of said collar and a flexible under hang, each of said plurality of detents vertically offset above the circular lower edge of said collar and having a lower width proximal to the circular lower edge of said collar that is less than an upper width proximal to said side wall, each of said plurality of detents separated by at least one of a plurality of outwardly extending ribs and a portion lacking horizontal detents, each of said plurality of outwardly extending ribs being orthogonal to said detents, said flexible under hang disposed below said plurality of detents, each of said plurality of outwardly extending ribs extending from between said plurality of detents into said flexible under hang;

a recess at an upper portion of said lid;

a raised border indent in said recess defining a circumference; and a disc engaged in the circumference.

15. The lid of claim 14 wherein the upper recess indent defines a volume.

16. The lid of claim 14 further comprising a container secured inside the dome and under the recess.

17. The lid of claim 1 wherein said flexible and expandable under hang compensates for variations in a diameter of said bucket about said lip.

18. A lid for a bucket, said lid comprising:

a side wall extending upward from a collar along a circular lower edge and forming a dome;

said collar selectively securing said lid to said bucket, said bucket being formed of paper or corrugated material and has a lip with a thickness along a circumference of a top portion of said bucket, where said collar has a plurality of horizontal detents each shaped as a trapezoid that project inward toward a central axis of said collar and to a greater extent than the circular lower edge to latch onto a bottom portion of said lip when said lip is within a specified thickness, each of said plurality of horizontal detents vertically offset above the circular lower edge of said collar and each of said plurality of horizontal detents having a lower width proximal to the circular lower edge that is less than an upper width proximal to said side wall;

a plurality of ribs separating each of said plurality of horizontal detents, each of said plurality of ribs being orthogonal to said plurality of horizontal detents, said plurality of ribs extending outward from said collar and positioned along a periphery of said collar, said plurality of ribs being parallel to an axis of the dome; and a flexible and expandable under hang disposed below said plurality of horizontal detents, said flexible and expandable under hang having a diameter, said under hang having an indentation with an inward spring force that grabs said lip of said bucket when said lip is greater than the specified thickness and when said lip is less than the diameter such that said plurality of horizontal detents latch onto a bottom portion of said lip;

wherein each of said plurality of ribs extends from between said plurality of horizontal detents into said flexible and expandable under hang; and wherein said flexible and expandable under hang compensates for variations in a diameter of said bucket about said lip.

* * * * *